US005492608A

United States Patent [19]

Sandoval et al.

[11] Patent Number: 5,492,608

[45] Date of Patent: Feb. 20, 1996

[54] ELECTROLYTE CIRCULATION MANIFOLD FOR COPPER ELECTROWINNING CELLS WHICH USE THE FERROUS/FERRIC ANODE REACTION

[75] Inventors: Scot P. Sandoval; William J. Dolinar, both of Reno, Nev.

[73] Assignee: The United States of America as represented by the Secretary of the Interior, Washington, D.C.

[21] Appl. No.: 403,605

[22] Filed: Mar. 14, 1994

[51] Int. Cl.[6] ..... C25C 7/00

[52] U.S. Cl. ..... 204/237; 204/275; 204/279

[58] Field of Search ..... 204/237, 234, 204/269, 275, 279

[56] References Cited

U.S. PATENT DOCUMENTS 3,876,516 4/1975 Pace ..... 204/108

4,098,668 7/1978 Andersen ..... 204/237

*Primary Examiner*—John Niebling

*Assistant Examiner*—Brendan Mee

*Attorney, Agent, or Firm*—E. Philip Koltos

[57] ABSTRACT

An improved electrolyte circulation manifold system for use in a copper electrowinning cell which includes an array of alternating cathode and anode plates positioned within a holding tank is disclosed. The manifold system itself includes a first manifold section positioned within the holding tank adjacent to a first lateral edge portion of each cathode plate and anode plate in the array. The first manifold section includes a first plurality of holes formed along it's length so that each hole is oriented in a horizontal plane and a single hole is positioned between and facing each anode plate and an adjacent cathode plate. A second manifold section is positioned within the holding tank adjacent to a second lateral edge portion of each cathode plate and anode plate in the array. The second manifold section includes a second plurality of holes formed along it's length so that each hole is oriented in a horizontal plane and a single hole is positioned between and facing each anode plate and an adjacent cathode plate. A pump is operable to pump an electrolyte solution through the first and second manifold sections and out of the first and second plurality of holes so that the electrolyte solution passes substantially horizontally between pairs of adjacent cathode plates and anode plates.

10 Claims, 5 Drawing Sheets

| ELECTROLYTE FLOW RATE (GAL/MIN) | CELL AND PUMPING POWER (WATTS) | MANIFOLD |
|---|---|---|
| 3.26 | 978.2 | 1/4 INCH HOLES |
| 3.60 | 988.1 | |
| 4.17 | 1002.8 | |
| 4.74 | 1009.4 | |
| 5.40 | 1017.9 | |
| 6.13 | 1015.8 | |
| 6.95 | 929.6 | |
| 7.76 | 873.4 | |
| 8.58 | 868.1 | |
| 3.10 | 983.3 | 1/4 INCH INJECTION 3/8 INCH SUCTION HOLES |
| 3.43 | 979.9 | |
| 4.09 | 987.4 | |
| 4.74 | 969.4 | |
| 5.40 | 903.0 | |
| 6.05 | 867.1 | |
| 7.03 | 860.8 | |
| 7.68 | 863.1 | |
| 8.34 | 870.3 | |
| 8.83 | 885.0 | |
| 9.16 | 891.8 | |
| 3.26 | 953.5 | 3/16 INCH HOLES |
| 3.60 | 926.5 | |
| 4.25 | 824.2 | |
| 4.91 | 705.6 | |
| 5.56 | 679.3 | |
| 6.38 | 701.8 | |
| 7.03 | 704.3 | |
| 8.18 | 735.0 | |
| 8.83 | 757.7 | |
| 9.65 | 785.5 | |
| 9.97 | 797.5 | |

| MANIFOLD | HOLE SIZE (INCHES) | ELECTROLYTE FLOW RATE (GAL/MIN/CATHODE) | MINIMUM CELL AND PUMPING POWER (WATTS) |
|---|---|---|---|
| A | 3/16 | 5.55 | 679.3 |
| B | 1/4 | 11.11 | 845.2 |
| C | 1/4 (INJECTION) 3/8 (SUCTION) | 10.29 | 805.7 |
| D | 1/4 | 8.74 | 880.7 |
| E | 3/16 | 8.08 | 785.6 |
| F | 1/8 | 8.66 | 764.4 |

| MANIFOLD | HOLE SIZE (INCHES) | ELECTROLYTE FLOW RATE (GAL/MIN/CATHODE) | MINIMUM CELL AND PUMPING POWER (WATTS) |
|---|---|---|---|
| A | 3/16 | 5.55 | 679.3 |
| B | 3/16 | 6.86 | 702.3 |
| C | 3/16 | 8.98 | 746.4 |
| D | 1/8 | 5.39 | 692.7 |

ELECTROLYTE CIRCULATION MANIFOLD FOR COPPER ELECTROWINNING CELLS WHICH USE THE FERROUS/FERRIC ANODE REACTION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates generally to an electrowinning cell for recovering copper from an electrolyte solution and, more particularly, to a manifold system for use with such an electrowinning cell operable to improve the circulation of electrolyte between the various electrodes of the cell and minimize the power requirements of both the cell and it's associated manifold system circulation pump.

2. Description of the Prior Art

The electrowinning of copper is becoming increasingly important to the competitiveness of the domestic copper industry. Production of electrowon copper has increased steadily since 1985, comprising 28% of the total domestic copper production, or 449,000 tons, in 1991. The energy requirement for producing copper in the electrowinning process is estimated to be 7.9 MJ/Kg (1 kw-hr/lb), which accounts for 20% of the energy requirement for producing copper in the leaching-solvent extraction-electrowinning (L-SX-EW) process. Given that the cost of energy will increase in the future, successful efforts to decrease the energy requirement for copper electrowinning will enhance the cost-effectiveness of the L-SX-EW process and will strengthen the competitiveness of the domestic copper industry.

One way to reduce the energy requirement for copper electrowinning is to use the ferrous/ferric anode reaction. The use of the ferrous/ferric anode reaction in copper electrowinning cells lowers the energy consumption of the cells as compared to conventional copper electrowinning cells which use the decomposition of water anode reaction. This is because the oxidation of ferrous to ferric iron occurs at a lower voltage than does the decomposition of water. However, maximum voltage reduction (and thus energy reduction) does not occur using the ferrous/ferric anode reaction unless effective circulation of electrolyte is achieved between the electrodes of the cell. This is due to the fact that the oxidation of ferrous to ferric iron in a copper electrolyte is a diffusion controlled reaction.

Several different schemes have hereto been employed in an attempt to improve the circulation of electrolyte between the electrodes of electrowinning and electrorefining cells without changing the design of the cells or electrodes. These known schemes include bubbling air from the bottom of the cell up between the electrodes, using sonic energy to induce circulation, and injecting electrolyte into the spaces between the electrodes using an electrolyte circulation manifold.

Air bubbling and sonic energy have associated with them environmental problems that affect the safety of the workers at the electrochemical facility. The electrowinning and electrorefining cells are open baths with the electrodes immersed into the electrolyte from the top of the cells. Air bubbles injected from the bottom of a cell rise and burst as they reach the top of the cell. The combination of many bursting bubbles causes a fine mist of the electrolyte to be carried up into the air above the cells. A principle component of the electrolyte is sulfuric acid. The electrolyte misting that occurs as a result of air bubbling increases the exposure of workers at the facility to sulfuric acid, affecting the worker's eyes and lungs. The use of sonic energy is also not preferred since sonic energy would affect workers' ears.

It is generally recognized that injecting electrolyte into the spaces between the electrodes of the electrowinning cell using a circulation manifold is the most effective way to induce electrolyte circulation without changing the design of the electrowinning and electrorefining cells and electrodes. In addition, this approach does not threaten the health of facility workers as does the utilization of air bubbling and sonic energy.

Although the use of a circulation manifold in place of air bubbling and sonic energy has been suggested and investigated to a certain extent, electrolyte circulation manifolds that circulate electrolyte over the entire face of the individual electrodes in the cell are currently viewed as requiring too much pumping energy to be useful.

Examples of various circulation manifold designs are disclosed in a paper entitled "The Electrowinning Of Copper Utilizing $SO_2$ And Graphite Anodes", J. C. Stauter and G. F. Pace, 75th Annual General Meeting Of The Canadian Institute Of Mining And Metallurgy, Vancouver, B.C. Canada, Apr. 15–18, 1973, and in U.S. Pat. No 3,876,516 to Pace et al. These disclosed circulation manifold designs are utilized in small-scale cells with electrodes 3 inches wide and 4 inches tall. The manifold itself includes at least three 1/64 inch diameter electrolyte injection holes located at each space between adjacent electrodes. One hole injects electrolyte vertically up between the adjacent electrodes and one hole on each side of the "vertical" hole injects electrolyte at 30 degrees from the vertical. However, it is noted that when the circulation manifold was scaled up for use with industrial size electrodes approximately 34 inches wide and 48 inches tall, a total of eight injection holes, four holes at each side of the cell and directed at each other, were used at each space between adjacent electrodes. This design significantly increases the complexity of the design itself and provides a clear indication of the difficulty of circulating electrolyte between the electrodes of a full-scale electrowinning cell.

Another known circulation manifold design for use in full-scale cells combines electrolyte injection and suction. In this design scheme, at each space between adjacent electrodes one 1/4 inch injection hole injects electrolyte vertically from the bottom center of the cell while two 3/8 inch suction holes, one on each side of the injection hole, remove electrolyte from the cell. Still another known circulation manifold design for use in full-scale cells includes one 1/4 inch hole injecting electrolyte at a 45 degree angle from the bottom corner of the electrowinning cell at each space between adjacent electrodes. This manifold is designed to circulate electrolyte over the bottom one-third of each cathode in the cell and relies on the fact that in conventional copper electrowinning, decomposition of water to form oxygen is the reaction occurring at each anode in the cell, producing bubbles that rise to the surface of the cell. This manifold design relies on the oxygen bubbling at each anode to provide electrolyte circulation for the top two-thirds of each cathode. However, oxygen bubbling produces acid misting which is hazardous to facility workers. In order to mitigate the misting problem, plastic balls or a foam layer are placed on the top of the cell in an attempt to cover the open cell top.

As may be seen from the foregoing, although several different circulation manifold designs exist for use in a copper electrowinning cell to circulate electrolyte through the cell, none of the known designs are without their difficulties. The difficulties include high energy consumption and/or the inability to circulate over the entire face of the electrodes without acid misting present. Consequently, there is a need for an improved electrolyte circulation manifold design for use with a copper electrowinning cell which both reduces the power requirements of the cell itself and its associated manifold circulation pump, and also enhances the safety aspects associated with the operation of the electrowinning cell.

SUMMARY OF THE INVENTION

The present invention relates to an improved electrolyte circulation manifold system for use in a copper electrowinning cell designed to satisfy the aforementioned needs. The improved electrolyte circulation manifold system of the present invention has a design optimized to enhance the energy consumption of the electrowinning cell and associated manifold circulation pump, and also enhance the safety-related aspects of the operation of the cell.

Accordingly, the present invention is directed to an improved electrolyte circulation manifold system for use in a copper electrowinning cell which includes an array of alternating cathode and anode plates positioned within a holding tank. The manifold system itself includes: (a) a first manifold section positioned within the holding tank adjacent to a first lateral edge portion of each cathode plate and anode plate in the array and including a first plurality of holes formed therein and located along the length of the first manifold section so that each hole is oriented in a horizontal plane and a single hole is positioned between and facing each anode plate and an adjacent cathode plate; (b) a second manifold section positioned within the holding tank adjacent to a second lateral edge portion of each cathode plate and anode plate in the array and including a second plurality of holes formed therein and located along the length of the second manifold section so that each hole is oriented in a horizontal plane and a single hole is positioned between and facing each anode plate and an adjacent cathode plate; and (c) means for pumping an electrolyte solution through the first and second manifold sections and out of the first and second plurality of holes so that the electrolyte solution passes substantially horizontally between pairs of adjacent cathode plates and anode plates.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
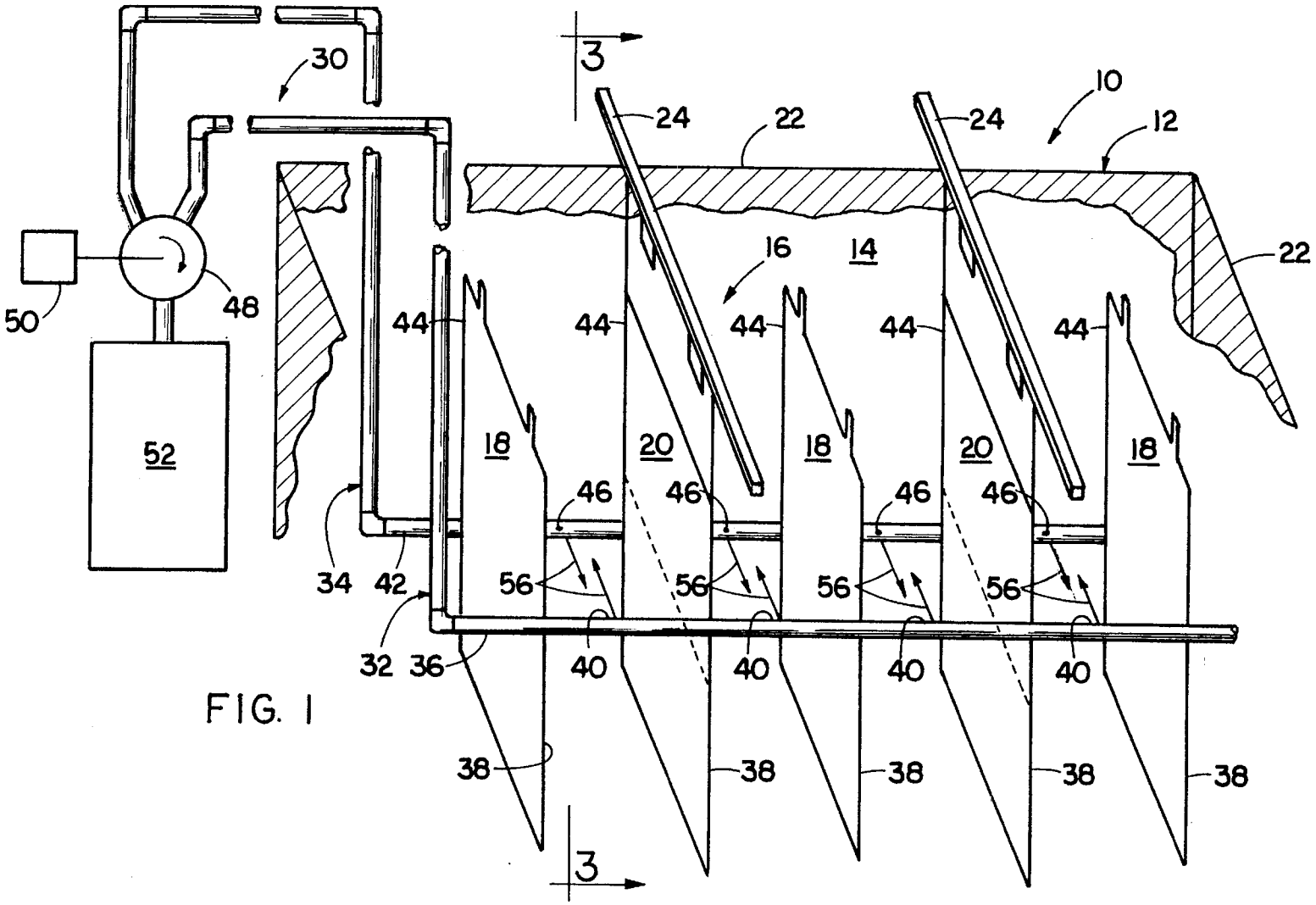
FIG. 1 is a perspective view of a copper electrowinning cell with the holding tank of the cell partially removed for clarity, illustrating an electrolyte circulation manifold system which is the subject of the present invention formed from a pair of manifold sections positioned to extend along the lateral edges of the cathode and anode plates forming the cell and connected to a circulation pump operable to provide a copper electrolyte solution to the pair of manifold sections.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

The present invention is directed to an improved electrolyte circulation manifold for use in a copper electrowinning cell which uses the ferrous/ferric anode reaction. The electrolyte circulation manifold described herein is an improvement over known and utilized circulation manifolds in that it minimizes the power requirements of the electrowinning cell itself and also minimizes the power requirements of the pump associated with the circulation manifold which operates to pump electrolyte through the manifold and into the electrowinning cell.

Referring now to the drawings, and particularly to FIG. 1, there is illustrated a perspective view of an electrowinning cell generally designated by the numeral 10 and operable to remove copper from an electrolyte solution circulated therethrough for future use. The electrowinning cell 10 is itself known in the art and includes a holding tank 12 partially broken away for clarity and having an interior portion 14 for holding an array 16 of electrodes in the form of alternating anode plates 18 and cathode plates 20. Each of the anode plates 18 and the cathode plates 20 hangs down into the interior 14 of the tank from the tank's upper edge portion 22. As seen particularly in FIG. 2, the interior 14 of the holding tank 12 is filled with an electrolyte 15 to a liquid level (L), and each of the anode plates 18 and the cathode plates 20 extends downwardly into the interior 14 of the holding tank 12 and thus into the electrolyte 15 to a depth (d).

Again referring to FIG. 1, although only the cathode plates 20 are shown as being connected with knife-edge apron bus bars 24, each of the anode plates 18 and cathode plates 20 in the array 16 of electrodes is connected with a knife-edge apron bus bar 24 as is well known in the art. Each of the bus bars 24 is operable to provide electrical power to its associated electrode in order to place the proper electrical charge on the electrode in preparation for the removal of copper from a copper-laden electrolyte circulated through the interior 14 of the holding tank 12.

In order to introduce the electrolyte solution 15 into the interior 14 of the holding tank 12, an electrolyte circulation manifold system which is the subject of the present invention and is generally designated by the numeral 30 is utilized. Again referring to FIG. 1, the circulation manifold system 30 includes a first manifold section 32 and a second manifold section 34. Both the first and second manifold sections 32, 34 are made from a non-metallic material, preferably PVC pipe. The first manifold section 32 includes a horizontal section 36 which is positioned to extend substantially horizontally within the interior 14 of the holding tank 12 adjacent to and along the first lateral edge portions 38 of the anode plates 18 and the cathode plates 20 in the array 16. Although not illustrated in FIG. 1, the horizontal section 36 of the first manifold section 32 includes a first plurality of holes formed therein and located the length of the horizontal section 36 so that each hole is oriented in a horizontal plane and a single hole is positioned between and facing each anode plate 18 and an adjacent cathode plate 20. Thus, for the circulation manifold configuration illustrated in FIG. 1, the horizontal section 36 includes a substantially horizontally-extending hole formed in the section 36 at each of the locations indicated by the numerals 40. It has been found through experimentation that optimum energy consumption occurs when each of the holes formed in the horizontal section is between ⅛ and ¼ inches in diameter, inclusive, and preferably 3/16 inches in diameter.

The second manifold section 34 of the manifold system 30 includes a horizontal section 42 which is positioned to extend substantially horizontally within the interior 14 of the holding tank 12 adjacent to and along the second lateral edge portions 44 of the anode plates 18 and the cathode plates 20 in the array 16. The horizontal section 42 of the second manifold section 34 includes a second plurality of holes 46 formed therein and located along the length of the horizontal section 42 so that each hole 46 is oriented in a horizontal plane and a single hole 46 is positioned between and facing each anode plate 18 and an adjacent cathode plate 20. As with the first plurality of holes formed in the horizontal section 36, the second plurality of holes 46 formed in the horizontal section 42 should be between ⅛ and ¼ inches in diameter, inclusive, and preferably 3/16 inches in diameter. For optimum electrolyte flow through the interior 14 of the holding tank 12, a single hole in the first plurality of holes and a single hole 46 in the second plurality of holes should be located at the midpoint between a particular anode plate 18 and an adjacent cathode plate 20 as illustrated in FIG. 1.

Both the first and second manifold sections 32, 34 are connected with an electrolyte circulation pump schematically illustrated in FIG. 1 and designated by the numeral 48. The pump 48 is driven by a motor 50 and is operable to transfer electrolyte from a storage tank 52 through the first and second manifold section 32, 34 and into the interior 14 of the holding tank.

The electrolyte circulation manifold 30 described herein is designed to optimize the energy consumption of the electrowinning cell 10 using the ferrous/ferric anode reaction and also optimize the energy consumption of the circulation pump 48 utilized to transfer electrolyte from the storage tank 52 to the interior 14 of the holding tank 12. The simple design described herein of two injection holes for each space between an anode plate 18 and an adjacent cathode plate 20 has been found to produce a lower energy consumption when compared to horizontal designs with more than a pair of injection holes between anode/cathode plate pairs. This is critical since it has been found to be extremely difficult to align injection holes in the manifold sections with the spaces between anode/cathode plate pairs due to the small gap between the plate pairs. Obviously, circulation manifolds with three or four injection holes for each space between anode/cathode plate pairs would be much more difficult to align than a circulation manifold with just two injection holes between plate pairs, one hole on each side of the electrowinning cell.

Figure 2:
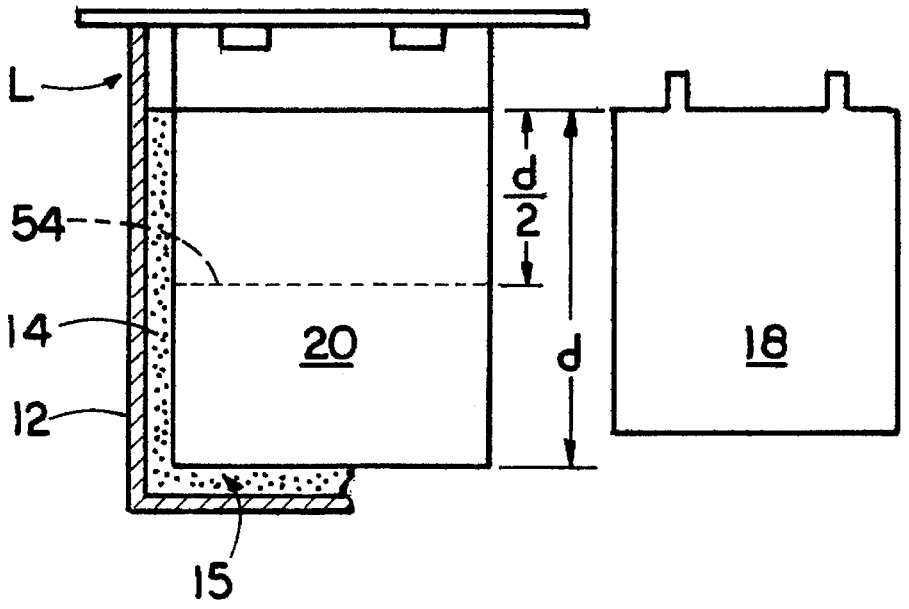
FIG. 2 is a frontal view of typical cathode and anode plates utilized in a copper electrowinning cell and placed in side-by-side relationship to illustrate how much of each cathode and anode plate is submerged in an electrolyte solution when positioned in an electrowinning cell.
Figure 3:
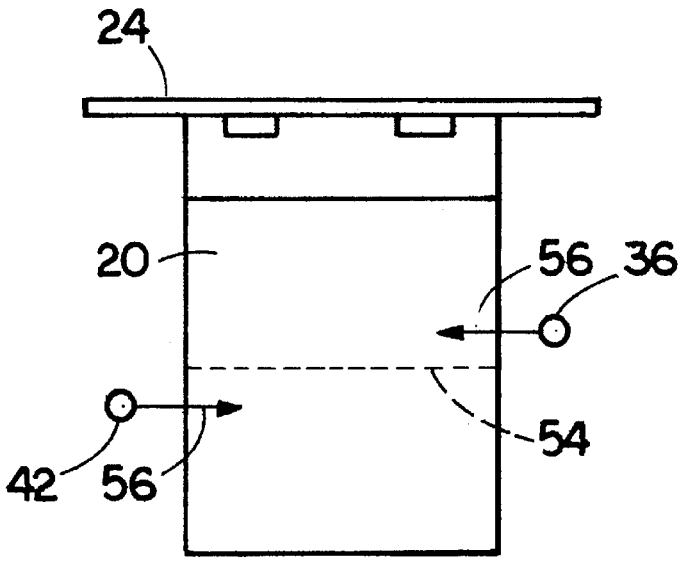
FIG. 3 is a front elevational view of a cathode plate as taken along line 3—3 of FIG. 1, illustrating the vertical positions of the manifold sections relative to each other and relative to the submerged horizontal centerline of the cathode plate.

A final consideration regarding the circulation manifold 30 of the present invention is the vertical spacing between the holes formed in the horizontal section 36 of the first manifold section 32 and holes formed in the horizontal section 42 of the second manifold section 34. Referring to FIGS. 2 and 3, each of the anode plates 18 and cathode plates 20 is submerged in the electrolyte 15 to a depth (d). Submerging the anode and cathode plates 18, 20 in the electrolyte 15 to a depth (d) defines a submerged horizontal centerline 54 for each of the anode plates 18 and cathode plates 20 at a depth (d/2). For optimum operation of the circulation manifold 30, it has been found that one of the horizontal sections 36, 42 should be positioned substantially horizontally in the interior 14 of the holding tank 12 a preselected distance above the horizontal centerline 54 and the other one of the horizontal sections 36, 42 should be positioned substantially horizontally in the interior 14 of the holding tank 12 a preselected distance below the horizontal centerline 54. This feature is illustrated in particular detail in FIG. 3, where, for example, the horizontal section 36 of the first manifold section 32 is positioned a preselected distance above the horizontal centerline 54 and the horizontal section 42 of the second manifold section 34 is positioned the same preselected distance below the horizontal centerline 54. It has been determined through experimentation that satisfactory energy consumption occurs with either the first or second horizontal section 36, 42 positioned between zero and ten inches, inclusive, above the horizontal centerline 54 and the other one of the first or second horizontal sections positioned between zero and ten inches, inclusive, below the horizontal centerline 54. Optimum energy consumption has been found to occur when one of the horizontal sections is 1.5 inches above the horizontal centerline 54 and the other horizontal section is 1.5 inches below the horizontal centerline 54. With the arrangement illustrated in FIG. 3, electrolyte pumped through the first and second manifold sections 32, 34 exits the first and second plurality of holes formed in the first and second horizontal sections 36, 42 to flow substantially horizontally between the anode/cathode plate pairs. Horizontal electrolyte flow between the anode/cathode plate pairs is illustrated in both FIGS. 1 and 3 by the directional arrows 56. A close vertical separation of 3 inches between the first and second horizontal sections 36, 42 has been found to yield the lowest energy consumption. However, copper deposit on the cathode plates 20 is thickest at the points where the electrolyte streams cross the cathode plates 20. Using the optimum horizontal section 36, 42 separation, the deposit of copper on the cathode plates 20 is slightly thinner at the top and bottom edges of the cathode plates 20 and slightly thicker at the center of the cathode plates 20. For purposes of stacking the copper deposits after harvesting them from the cathode plates 20, it may be desirable to increase the vertical distance between the first and second plurality of holes to as much as 20 inches, so that the slightly thicker copper deposits on the cathode plates 20 are at approximately ½ and ¾ the height of the cathode plates 20. However, this will consume more energy than the optimum vertical distance of 3 inches. Increasing the vertical distance between the first and second horizontal sections 36, 42 beyond 20 inches may cause the electrolyte at the surface of the electrowinning cell 10 to agitate resulting in acid misting.

EXAMPLES

An electrowinning cell such as the electrowinning cell 10 was constructed measuring 55 inches high, 50 inches wide and 16 inches long. The volume of electrolyte in the cell measured approximately 155 gallons. The cell held as many as two full-size cathode plates 20 and three full-size anode plates 18. The cathode plates 20 were ⅛ inches thick 316 stainless steel having an immersed surface area of 40 inches high by 39 inches wide. The anode plates 18 were ¼ inches thick DSA anodes, a titanium substrate with an iridium oxide coating, and had an immersed surface area of 39 inches high by 36 inches wide. Electrical contact with the cathode and anode plates was made using standard knife-edge apron bus bars on the cell. An immersion heater was used to heat the electrolyte in the cell 10 to an operating temperature of 40 degrees C.

Electrolyte was fed into the cell using a metering pump at a rate of 0.65 gallons/minute. The feed contained 44 g/L $Cu^{2+}$, 26 g/L $Fe^{2+}$, 2 g/L $Fe^{3+}$ and 140 g/L $H_2SO_4$. Lean electrolyte exited the cell by overflow and contained 36 g/L $Cu^{2+}$, 26 g/L $Fe^{2+}$, 2 g/L $Fe^{3+}$ and 164 g/L $H_2SO_4$.

Electrolyte was circulated from the cell through activated carbon modules, where the electrolyte was treated with $SO_2$, and then returned to the cell. The $SO_2$ reduced the $Fe^{3+}$ formed in the cell, thereby maintaining the level of $Fe^{2+}$ at a constant level in the electrolyte. The oxidation of $SO_2$ resulted in the increase in $H_2SO_4$ concentration across the cell. Use of the $SO_2$-activated carbon combination produced an emissionless electrowinning cell since there was no acid misting (with the ferrous/ferric couple) and there were no $SO_2$ emissions because all of the $SO_2$ reacted in the activated carbon modules.

A second circulation line circulated electrolyte from the cell to the circulation manifold being tested, through which the electrolyte was reintroduced into the cell. A variable frequency controller on the manifold circulation pump was used to vary pump speed. A watt meter was used to measure the power requirement of the manifold circulation pump during the testing. A data logger recorded cell voltage from which the electrowinning cell power requirement was determined.

The conditions of the testing were 24 amp/ft$^2$, 40 degrees C, and approximately 3 to 11 gallons/minute circulation rate through the circulation manifold being tested. The circulation manifold was made out of 1 and ½ inch schedule 40 PVC pipe. Circulation manifold holes were drilled using standard drill bits.

The tests were conducted by placing a circulation manifold in the cell and increasing the pumping rate over a given range while the cell was operating. The reaction occurring at the anode plate was the oxidation of $Fe^{2+}$ to $Fe^{3+}$. The reaction occurring at the cathode plate was the conventional copper plating reaction. As the pumping rate through the circulation manifold was increased, cell voltage decreased because diffusion of $Fe^{2+}$ to the anode plate was enhanced. The object of the testing was to minimize energy consumption of the electrowinning cell and manifold circulation pump by determining the optimum circulation manifold design.

Figure 4:
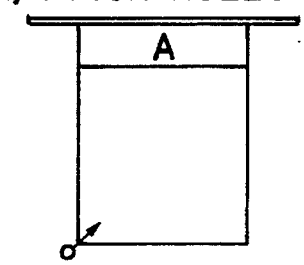
FIG. 4 is a chart which provides a comparison between the operating parameters of the electrolyte circulation manifold system of the present invention and two known electrolyte circulation manifold systems.
Figure 4:
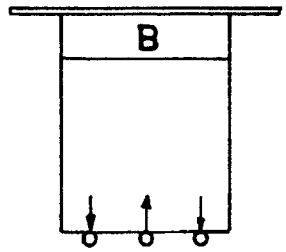
Figure 4:
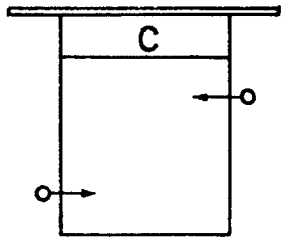

1.) A test was conducted comparing the circulation manifold system of the present invention as illustrated and described herein with two designs described in the "Description of Prior Art" section of this document and displayed in FIG. 4, where design C is the circulation manifold of the present invention as illustrated in FIG. 3 and circulation manifold designs A and B are the prior art manifold designs. One cathode plate and two anode plates were used in the testing. As is clearly seen from the Table portion of FIG. 4, the circulation manifold design of the present invention designated by the letter C achieved a minimum electrowinning cell and circulation pump power requirement of 679.3 watts, compared to 868.1 and 860.8 watts for the two prior art circulation manifold designs A and B.

Figure 5:
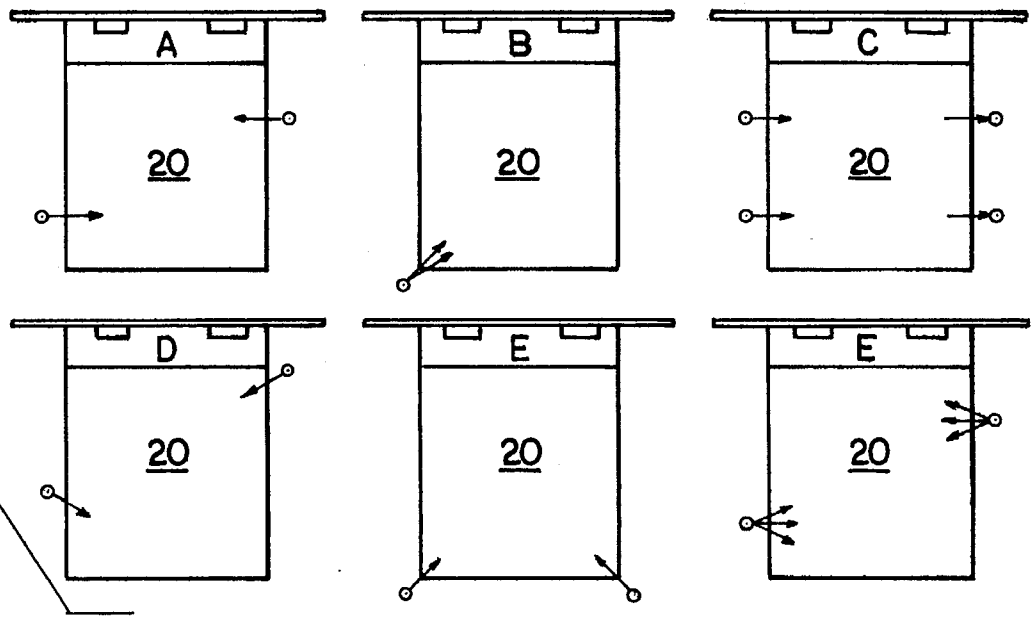
FIG. 5 is a chart which provides a comparison between the operating parameters of the electrolyte circulation manifold system of the present invention and various known or tested electrolyte circulation manifold systems.

2.) A test was conducted comparing the circulation manifold system of the present invention as illustrated and described herein with designs that inject electrolyte into the electrowinning cell at angles other than horizontal and one that injects horizontally with both injection holes on one side, combined with suction holes on the other side. One cathode plate and two anode plates were used in the test. The various circulation manifold designs tested and the results are displayed in FIG. 5, where design A is the circulation manifold of the present invention as illustrated in FIG. 3 and circulation manifold designs B through F are the prior art or tested manifold designs. As is clearly seen from the Table portion of FIG. 5, the circulation manifold design of the present invention designated by the letter A required the least amount of electrowinning cell and circulation pump power as measured in watts. It was found as part of this testing that manifold designs which injected from the sides of the cathode plates through injection holes angled upwardly agitated the electrolyte surface of the cell. This surface agitation contributed to acid misting. Conversely, the horizontal design of the present invention produced a smooth movement of electrolyte between the electrode plates and contributed very little to acid misting.

Figure 6:
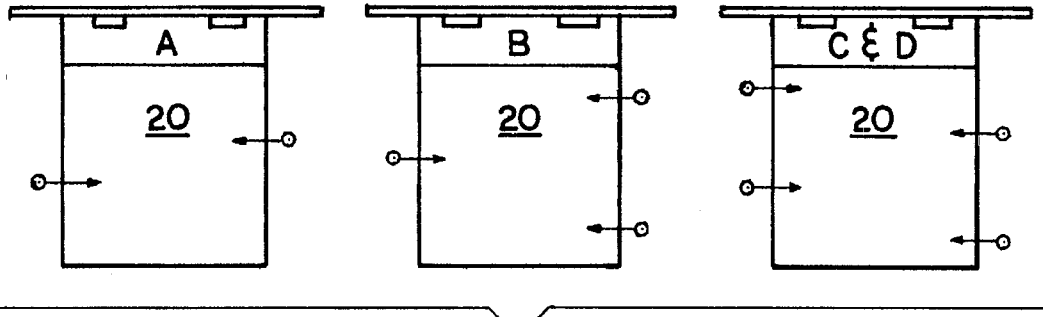
FIG. 6 is another chart which provides a comparison between the operating parameters of the electrolyte circulation manifold system of the present invention and various known or tested electrolyte circulation manifold systems.

3.) A test was conducted comparing the circulation manifold system of the present invention as illustrated and described herein with designs having three and four injection holes for each space between an anode plate and an adjacent cathode plate and the hole sizes ranging from between 3/16 and ⅛ inches. The various circulation manifold designs tested and the results are displayed in FIG. 6, where design A is the circulation manifold of the present invention as illustrated in FIG. 3. One cathode plate and two anode plates were used in the test. As is again clearly seen from the Table portion of FIG. 6, the simple circulation manifold design of the present invention designated by the letter A required the least amount of electrowinning cell and circulation pump power as measured in Watts. This is important because the more complex designs would be more difficult to install and align given the small anode/cathode plate spacing in a conventional electrowinning cell.

It should be noted that the circulation manifold system of the present invention may also be used in copper electrorefining cells since these cells use approximately the same size electrode plates and anode/cathode plate spacing as copper electrowinning cells. Copper electrorefining is also similar to copper electrowinning using the ferrous/ferric anode reaction because there is no gas bubbling between the electrodes. At the anode plate, copper ions come into solution from the impure copper anode plate, and at the cathode plate copper ions plate out as pure copper. The circulation manifold of the present invention is directly applicable to this system. Improved circulation between the electrodes in a copper electrorefining process will allow current density, and therefore cell productivity, to be increased while maintaining a smooth copper deposit at the cathode plates. A smooth deposit at the cathode plates is essential for the purity of the deposit because a smooth deposit has fewer cavities in which electrolyte can become entrained. Increasing current density without enhanced circulation as provided by the circulation manifold of the present invention produces a rough, impure deposit.

It is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages, the forms hereinbefore described being merely preferred or exemplary embodiments thereof.

We claim:

1. An improved electrolyte circulation manifold system for use in a copper electrowinning cell which includes an array of alternating cathode and anode plates positioned within a holding tank, comprising:

(a) a first manifold section positioned within said holding tank adjacent to a first lateral edge portion of each cathode plate and anode plate in said array and including a first plurality of holes formed therein and located along the length of said first manifold section so that each hole is oriented in a substantially horizontal plane and a single hole is positioned between and facing each anode plate and an adjacent cathode plate;

(b) a second manifold section positioned within said holding tank adjacent to a second lateral edge portion of each cathode plate and anode plate in said array and including a second plurality of holes formed therein and located along the length of said second manifold section so that each hole is oriented in a substantially horizontal plane and a single hole is positioned between and facing each anode plate and an adjacent cathode plate; and (c) means for pumping an electrolyte solution through said first and second manifold sections and out of said first and second plurality of holes so that said electrolyte solution passes substantially horizontally between pairs of adjacent cathode plates and anode plates.

2. The improved electrolyte circulation manifold system as recited in claim 1, wherein a single hole in said first array and a single hole in said second array are each positioned substantially at the midpoint between each anode plate and an adjacent cathode plate.

3. The improved electrolyte circulation manifold system as recited in claim 1, wherein:

each cathode plate in said array is submerged in said electrolyte solution within said holding tank to a depth (d) to define a submerged horizontal centerline located at a depth (d/2) beneath the surface of said electrolyte solution; and one of said first and second manifold sections is positioned substantially horizontally in said holding tank a preselected distance above said horizontal centerline and the other one of said first and second manifold sections is positioned substantially horizontally in said holding tank the same preselected distance below said horizontal centerline.

4. The improved electrolyte circulation manifold system as recited in claim 3, wherein said one of said first and second manifold sections is positioned between 0 and 10 inches, inclusive, above said horizontal centerline and the other one of said first and second manifold sections is positioned between 0 and 10 inches, inclusive, below said horizontal centerline.

5. The improved electrolyte circulation manifold system as recited in claim 4, wherein said one of said first and second manifold sections is positioned 1.5 inches above said horizontal centerline and the other one of said first and second manifold sections is positioned 1.5 inches below said horizontal centerline.

6. The improved electrolyte circulation manifold system as recited in claim 1, wherein each hole in said first plurality of holes is between ⅛ and ¼ inches in diameter, inclusive.

7. The improved electrolyte circulation manifold system as recited in claim 6, wherein each hole in said first plurality of holes is 3/16 inches in diameter.

8. The improved electrolyte circulation manifold system as recited in claim 1, wherein each hole in said second plurality of holes is between ⅛ and ¼ inches in diameter, inclusive.

9. The improved electrolyte circulation manifold system as recited in claim 8, wherein each hole in said second plurality of holes is 3/16 inches in diameter.

10. The improved electrolyte circulation manifold system as recited in claim 1, wherein each of said first and second manifold sections are made from PVC pipe.

* * * * *